US005520549A

United States Patent [19]

Tanaka et al.

[11] Patent Number: 5,520,549

[45] Date of Patent: May 28, 1996

[54] CONNECTOR APPARATUS, HOUSING, AND CONNECTING ELEMENT

[75] Inventors: Kiyotaka Tanaka, Sagamihara; Tomio Tsukazaki, Michida, both of Japan

[73] Assignee: Minnesota Mining and Manufacturing Company, St. Paul, Minn.

[21] Appl. No.: 325,710

[22] Filed: Oct. 19, 1994

[51] Int. Cl.[6] ..... H01R 4/26

[52] U.S. Cl. ..... 439/402

[58] Field of Search ..... 439/213, 322, 439/402

[56] References Cited

U.S. PATENT DOCUMENTS

| | | | |
|---|---|---|---|
| 3,388,370 | 4/1966 | Elm | 439/402 |
| 3,573,713 | 4/1971 | Enright et al. | 439/402 |
| 3,793,612 | 2/1974 | Driscoll | 439/402 |
| 3,858,157 | 12/1974 | Bazille, Jr. | 339/98 |
| 3,899,236 | 8/1975 | Santos | 439/402 |
| 3,912,356 | 11/1975 | Johansson | 439/402 |
| 4,178,055 | 12/1979 | Fleischhacker et al. | 439/402 |
| 4,861,278 | 8/1989 | McBride et al. | 439/395 |

FOREIGN PATENT DOCUMENTS

| | | | |
|---|---|---|---|
| 2640823 | 6/1990 | France | 439/402 |
| 51-1992 | 1/1976 | Japan | H01R 7/00 |
| 53-3418 | 1/1978 | Japan | E04D 13/15 |
| 2161994 | 1/1986 | United Kingdom | 439/402 |

*Primary Examiner*—P. Austin Bradley
*Assistant Examiner*—Jill DeMello
*Attorney, Agent, or Firm*—Gary L. Griswold; Walter N. Kirn; Jack V. Musgrove

[57] ABSTRACT

The invention provides a connector for connecting a branch conductor to an insulated double core cable without cutting the cable or stripping the insulation from the cable. The connector includes a connecting element adapted to pierce the cable insulation to contact the conducting core and a insulative wedge adjacent the connecting element which pierces the cable insulation to maintain the conductive cores of the cable apart from one another.

2 Claims, 9 Drawing Sheets

CONNECTOR APPARATUS, HOUSING, AND CONNECTING ELEMENT

FIELD OF THE INVENTION

The present invention relates to an insulation displacement connector apparatus.

BACKGROUND OF THE INVENTION

In domestic low-voltage wiring, one form of wiring is a double-core flat cable insulated with vinyl insulation (referred to as VVF cable), in which two insulated electric wires extend in parallel and are surrounded by a sheath (protection cover) of a generally oval shape. To extend a branch electric wire from such a VVF cable two connections discussed below are selectively used; (1) a sleeve comprised of a metal tube which is provided, on an inner peripheral surface with a helical groove (see Japanese Utility Kokoku Publication No. 53-3418), and (2) a connector having a connecting element which pierces the insulation of the electric wires which are inserted in respective parallel circular holes, so that the connecting element comes into electrical contact with the electric wires to establish an electrical connection therebetween (see Japanese Patent Kokai Publication No. 51-1992). In the branching operation using the sleeve mentioned above, the VVF cable is cut to remove the sheath and the insulation to expose the electric wire. If the branch conductor is made of a similar VVF cable, the latter is similarly cut to remove the sheath and the insulation. If the branch conductor is a single wire, the insulation thereof is removed to expose the conductor. Thereafter, the exposed conductor portion of the main conductor and the exposed conductor portion of the branch conductor are forced into the sleeve to connect them.

In the branching operation using the connector, the sheath of the VVF cable of the main conductor is removed to produce two portions corresponding to the electric wires. If the branch electric wire is made of the VVF cable, the sheath thereof is removed, and if the branch conductor is made of a single wire, no operation is needed. After that, one of the portions corresponding to the electric wires of the main conductor and the corresponding electrical wire or the portion equivalent thereto of the branch conductor are inserted in the respective holes of the connector. After that the connecting element is mounted to the connector body to pierce the insulation of the electric wires to thereby establish an electrical connection therebetween. Similarly to the foregoing, another connecting element is mounted to the connector body to electrically connect the other portion corresponding to the electrical wire of the main conductor and the corresponding electric wire or the portion equivalent thereto of the branch conductor.

In the connection method utilizing a sleeve, not only is the cutting operation of the VVF cable on the main conductor side necessary, but also operations such as removal of the sheaths and the insulations of both the main conductor and the branch conductor are required. In addition, the conductor portions might be accidentally damaged upon removal of the sheaths and insulation.

In the case where the connector is used, the removal of the sheath of the VVF cable on the main conductor side, and the removal of the VVF cable on the branch conductor side, if the branch conductor is made of the VVF cable, are necessary.

It is, therefore, an object of the present invention to provide a simple and inexpensive connector apparatus in which neither the cutting of the main conductor cable, nor the removal of the sheaths and insulations of the main conductor cable and the branch conductor cable are necessary.

SUMMARY OF THE INVENTION

To solve the problems mentioned above, according to the present invention, there is provided a connector apparatus, comprising (a) at least one connecting element having at least two conductive connecting portions spaced from one another, and, (b) a housing including a main conductor inserting portion in which a main conductor having an insulated multi-core cable can be inserted, a branch conductor inserting portion in which a branch conductor having an insulated electric wire and/or an insulated multi-core cable can be inserted, and a connecting element inserting portion in which the connecting element can be inserted, wherein when the connecting element is inserted in the connecting element inserting portion, at least one of said two conductive connecting portions pierces the insulation of the main conductor to be engaged by and electrically connected to one core of the main conductor, and the other conductive connecting portion pierces the insulation of the branch conductor to be engaged by and electrically connected to one core of the corresponding branch conductor, so that an electrical connection therebetween can be established.

According to another aspect of the present invention, a housing includes a main conductor inserting portion in which a main conductor having an insulated multi-core cable can be inserted, a branch conductor inserting portion in which a branch conductor having an insulated electric wire and/or an insulated multi-core cable can be inserted, and a connecting element inserting portion in which a connecting element including at least two conductive connecting portions spaced from one another can be inserted, wherein when the connecting element is inserted in the connecting element inserting portion, at least one of said two conductive connection portion pierces the insulation the main conductor to be engaged by and electrically connected to one core of the main conductor, and the other conductive connection portion pierces the insulation of the branch conductor to be engaged by and electrically connected to one core of the corresponding branch conductor, so that an electrical connection therebetween can be established.

Preferably, the main conductor inserting portion and/or the branch conductor inserting portion are opened so as to permit the main conductor and/or the branch conductor to be inserted therethrough in the lateral direction, and the opening(s) can be expanded or contracted about a predetermined portion thereof opposite to the openings(s).

Preferably, provision is made of a hinged cover on the housing body, which is provided on a free end thereof with an engaging portion, so that when the hinged cover is closed, the engaging portion can be engaged by an associated engaging portion of the housing body to maintain a constant width of the opening(s).

Preferably, the main conductor inserting portion and/or said branch conductor inserting portion are provided with conductor holding means and/or cable holding means to protect the same.

Finally, provision is made for a wedge member which is forced between the cores of the main conductor while cutting the insulation thereof located at the center of the main conductor so as to facilitate the insertion of the conductive connecting portions which take place thereafter.

Preferably, the wedge member is made of an insulating material.

The wedge portion of the connection element first cuts the insulation of the main conductor located at the center portion thereof when the connecting element is inserted and, accordingly, the insertion of the conductive connecting portions that would occur later on can be easily effected. Moveover, since the wedge portion is forced between the cores of the main conductor, the distance between the cores can be maintained constant. If the wedge portion is made of an insulating material, the insulation between the cores can be ensured.

BRIEF DESCRIPTION OF THE DRAWINGS

The present invention will be more thoroughly described with reference to the accompanying drawings, wherein like numbers refer to like parts in the several views, and wherein.

DESCRIPTION OF THE PREFERRED EMBODIMENTS

Figure 1:
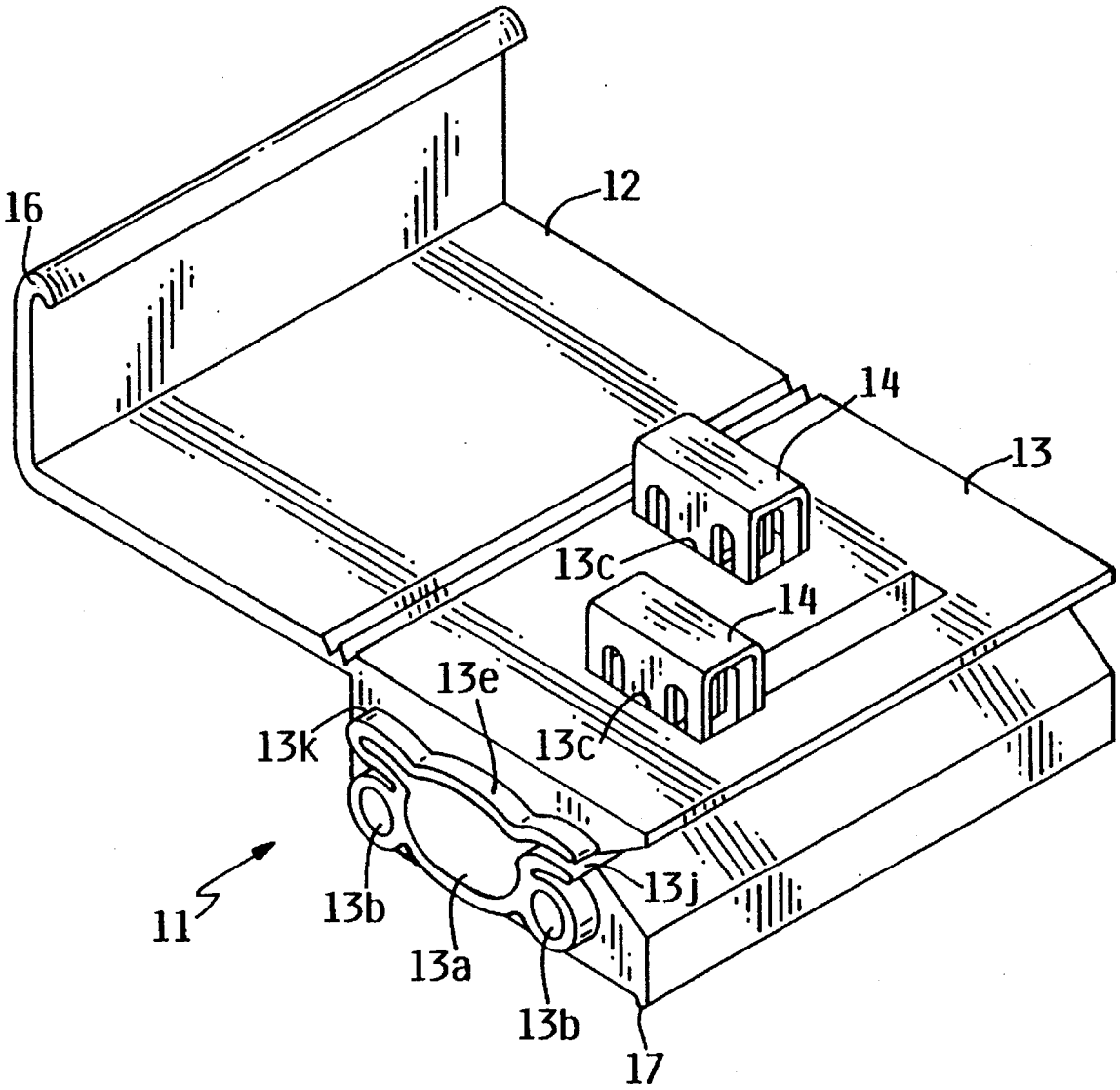
FIG. 1 is a perspective view of a connector apparatus according to a first embodiment of the present invention.
Figure 2:
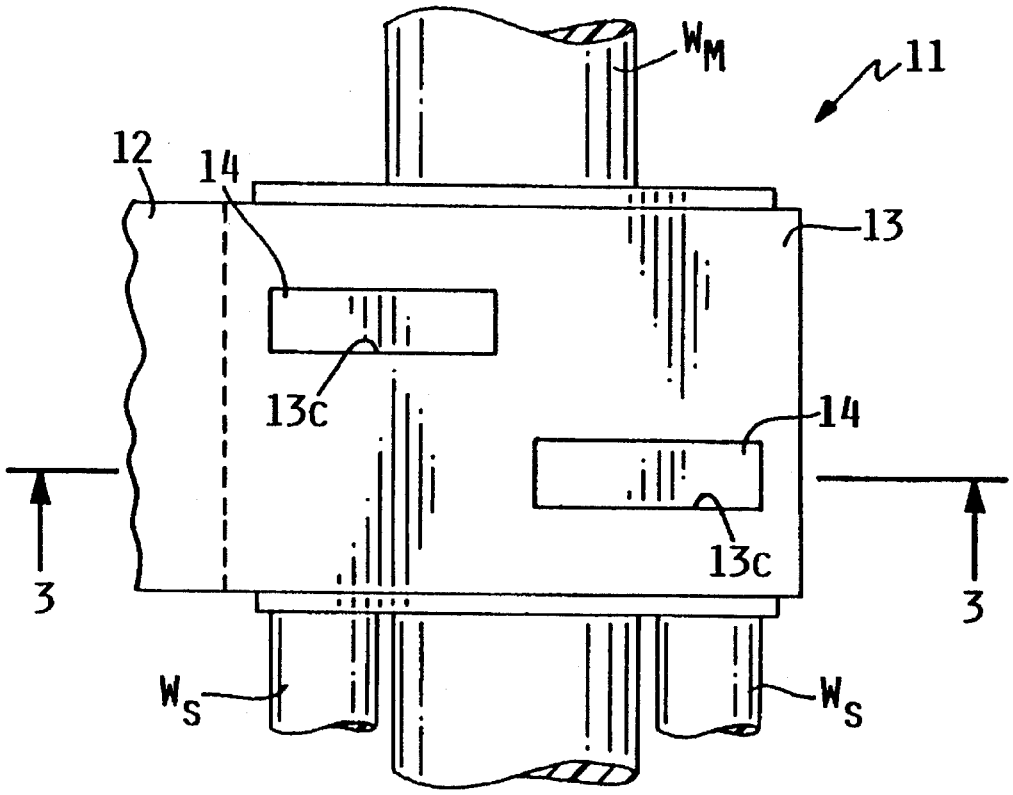
FIG. 2 is a top plan view of the embodiment of FIG. 1.

The following discussion will be addressed to a first embodiment of the present invention, with reference to FIGS. 1 through 5. A connecting apparatus 11 of the first embodiment is essentially comprised of a housing 13 which is provided on one end thereof with a hinged insulating cover 12 and two connecting elements 14 which can be attached to and inserted in the housing 13 at the upper surface.

The housing 13 which is made of, for example, a soft plastic material such as insulating polypropylene or nylon, is provided, on the center portion thereof in the longitudinal direction, with a main conductor inserting portion 13*a* of a generally oval shape in which a double-core flat cable $W_M$ insulated with a vinyl insulation (VVF cable) can be inserted.

On opposite sides of the main conductor inserting portion 13*a* of the housing 13 are provided parallel branch conductor inserting portions 13*b* of a circular cross-sectional shape. The branch conductors $W_S$, which are each in the form of a single electric wire in the illustrated embodiment, are inserted in the respective branch conductor inserting portions 13*b*.

The housing 13 is provided on the side surface thereof with a slit (opening) 13*j* which is connected to the main conductor inserting portion 13*a*, so that the housing 13 can be elastically deformed to expand or contract the slit 13*j*. Namely, the opening 13*j* can be extended or contracted about a hinge portion 13*k* opposite the slit 13*j*. Consequently, the main conductor $W_M$ can be inserted in the main conductor inserting portion 13*a* through the slit 13*j* in the lateral direction without cutting the main conductor $W_M$. Furthermore, upon completion of the insertion of the main conductor $W_M$, the hinged cover 12 is closed to close the slit 13*j* of the housing 13. An engaging portion 16 in the form of a hook provided at the free end of the cover 12 is engaged by a projection (associated engaging portion) 17 provided on the bottom of the housing. Thus, the housing 13 is maintained in a closed state. Namely, the width (gap) of the slit 13*j* is maintained constant, so that no accidental disengagement of the main conductor $W_M$ from the main conductor inserting portion 13*a* in the lateral direction takes place. Note that it is possible to provide similar slits or cut-away portions connected to the branch conductor inserting portions 13*b* in order to permit the branch conductors $W_S$ to be inserted in the respective branch conductor inserting portions 13*b* in the lateral direction without cutting the branch conductors $W_S$.

There are two connecting element inserting portions 13*c*, in which the connecting elements 14 can be inserted, on the upper surface of the housing 13. The connecting element inserting portions 13*c* are in an orthogonal arrangement. Each of the connecting element inserting portions 13*c* is connected to the main conductor inserting portion 13*a* and one of the branch conductor inserting portion 13*b*.

The connecting element 14 is made of a plate of, for example, copper or a copper alloy such as brass, phosphor bronze, or beryllium copper. The plate is then subject to a solder plating or copper plating, and is bent into a U-shape. The connecting element 14 is provided on opposite sides thereof with two pairs of recesses (conductive connecting portions) 14*a*, 14*b* in which two pairs of electric wires can be received.

Figure 3:
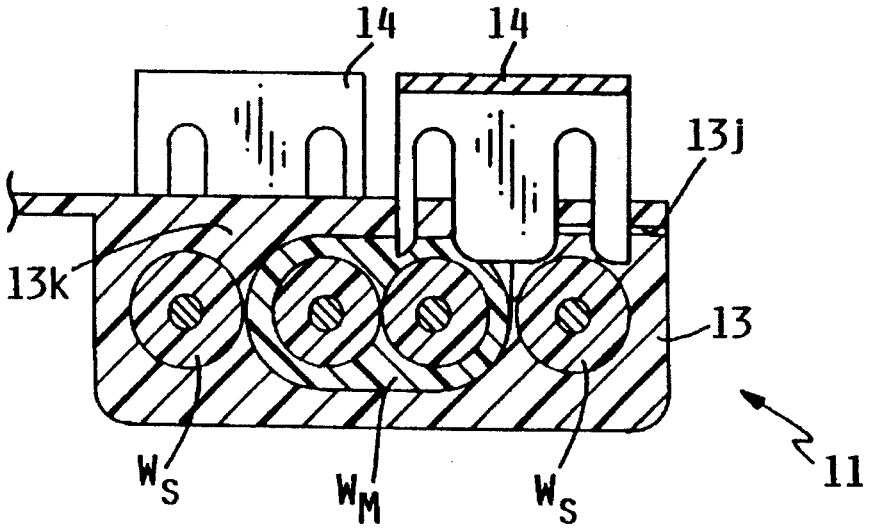
FIG. 3 is a cross-sectional view taken along the line 3—3 of FIG. 2.
Figure 4:
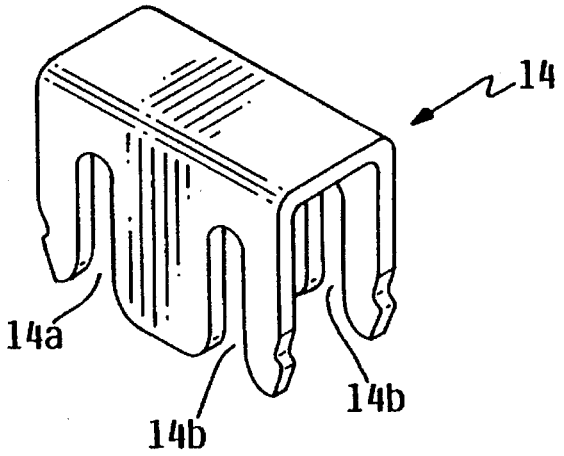
FIG. 4 is a perspective view of a connecting element portion of the embodiment of FIG. 1.

As can be seen in FIG. 3, which shows an intermediate step of the assembly, when the connecting elements 14 are inserted in the respective connecting element inserting portions 13*c* of the housing 13, the two conductive connecting portions 14*a* on one side of the connecting element 14 pierce the insulation (sheath and insulating member) of the main conductor (VVF cable) $W_M$ and thrust into one core of the main conductor to be electrically connected thereto. The conductive connecting portions 14*b* on the other side of the connecting element 14 pierce the insulation (insulating member) of the branch conductors (single electric wires) $W_S$ to be electrically connected to the corresponding core of the branch conductors.

As can be understood from the above discussion, one of the cores of the main conductor $W_M$ is electrically connected to the electric wire (core) of the branch conductor $W_S$ by a second connecting element 14, and the other core of the main conductor $W_M$ is electrically connected to another electric wire (core) of the branch conductor $W_S$ by a second connecting element 14, respectively.

Namely, in the present invention, the branching operation of the branching conductor (single electric wire) $W_S$ from the main conductor $W_M$ can be easily and quickly carried out. The upper surfaces of the connecting elements 14 are finally covered and insulated by the hinged cover 12, thus resulting in safe operation.

Figure 5A:
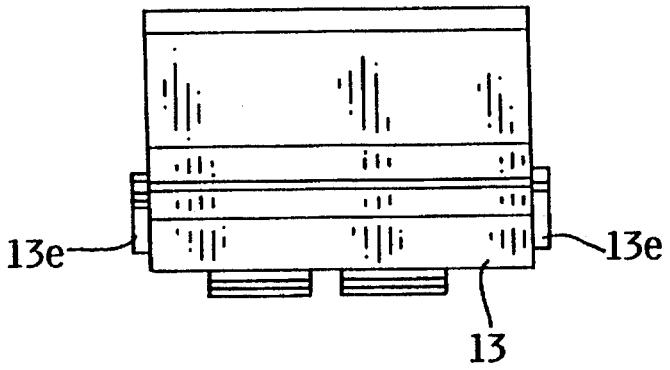
FIG. 5A is a side elevational view of the connector apparatus of FIG. 1.
Figure 5B:
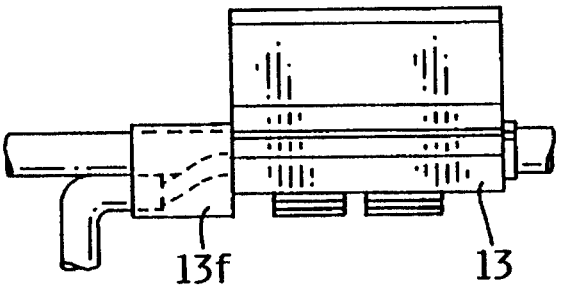
FIG. 5B is a view similar to FIG. 5A with cabeling attached.

The electric wire/cable holding portions 13*e* which exhibit elasticity due to the thinness thereof are provided at the inlet and outlet ends of the branch conductor inserting portions 13*b* and the main conductor 13*a*, to prevent bending force from being excessively concentrated at the main conductor $W_M$ and the branch conductors $W_S$ as shown in FIG. 5A. Taking into account that the electric wire of the branch conductor may be one which is obtained by removing the insulating sheath from the VVF cable, it is possible to provide longer holding portions 13*f* which can protect the cable sheath, as shown in FIG. 5B.

Figure 6:
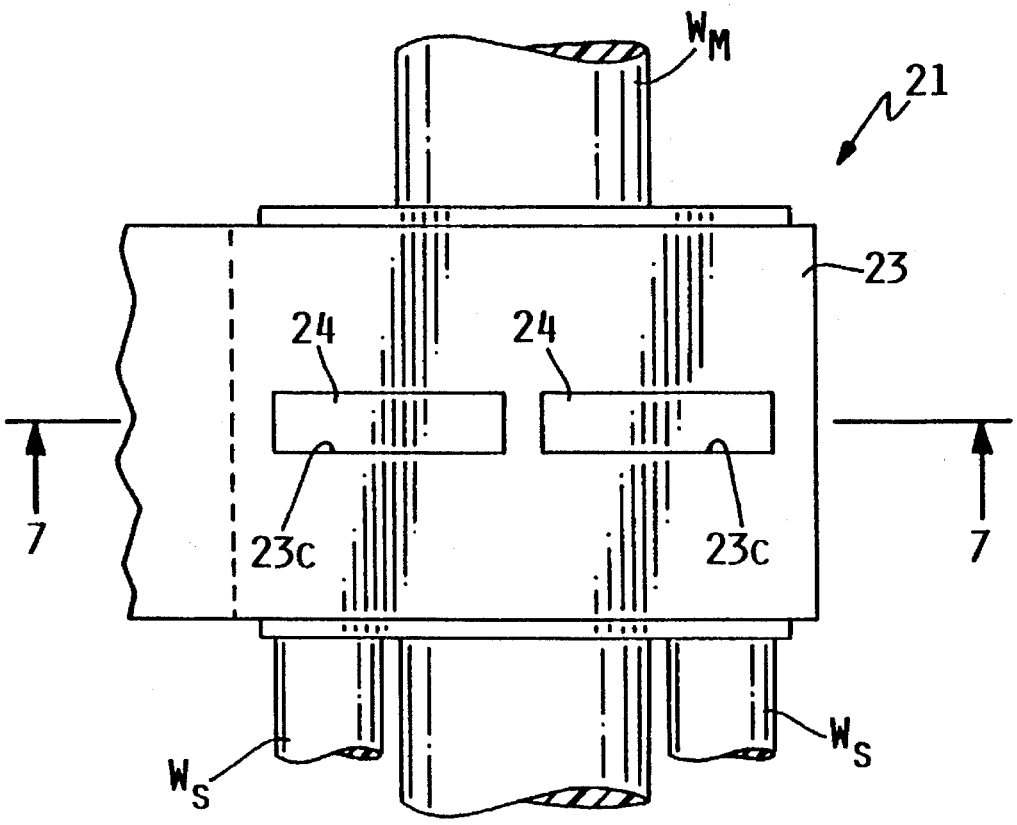
FIG. 6 is a plan view of a connector apparatus according to a second embodiment of the present invention.
Figure 7:
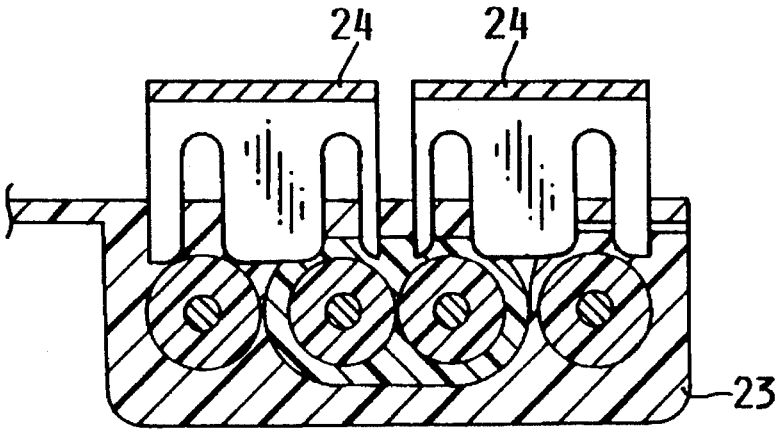
FIG. 7 is a cross-sectional view taken along the line 7—7 of FIG. 6.
Figure 8:
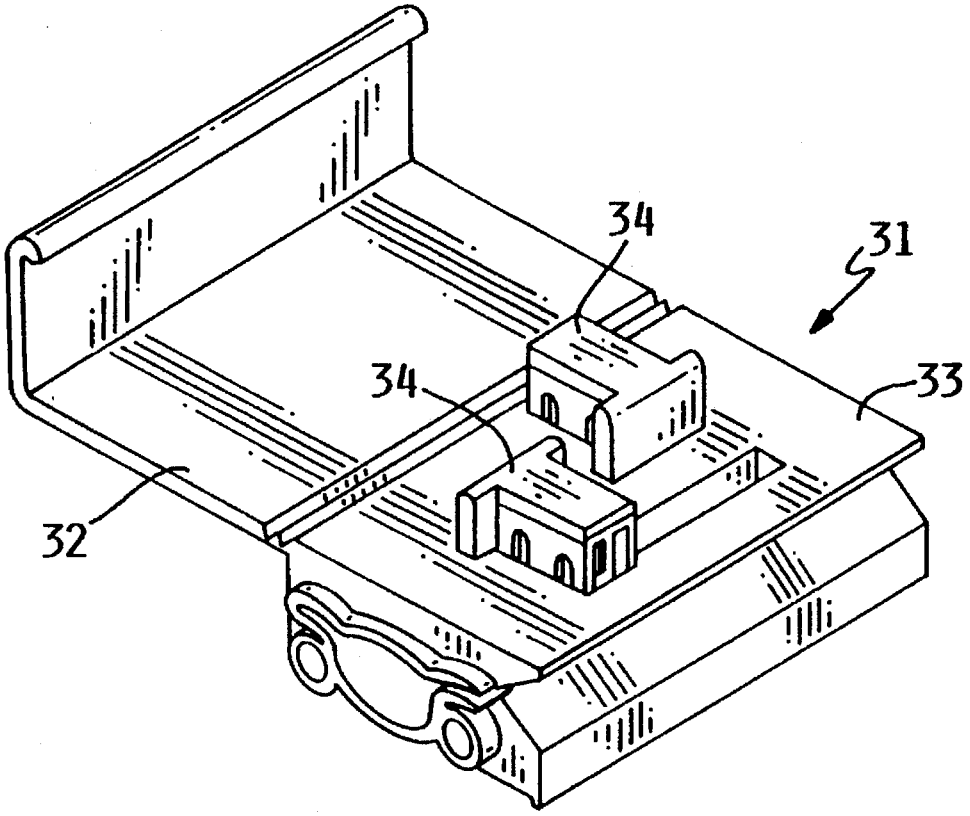
FIG. 8 is a perspective view of a third embodiment of a connector apparatus according to the present invention.

As can be seen from FIGS. 6 and 7, the connector apparatus 21 of the second embodiment is substantially identical to the first embodiment (FIGS. 1 through 5), except for the arrangement of the two connecting element inserting portions 23*c* of the housing 23, in which the connecting element inserting portions 23C are aligned in a row perpendicular to the longitudinal direction.

As can be seen from FIGS. 8 through 11, the connector apparatus 31 of the third embodiment is similar to the first embodiment (FIGS. 1 through 5) except for the presence of a wedge member 35 provided on one side of the connecting element 34. The following discussion will be directed to the difference only.

The wedge member 35 is sharpened at the front end thereof and has a vertical length slightly longer than that of the conductive connecting portions 34*a* and 34*b*, so that the wedge member 35 projects downward from the latter. Consequently, when the connecting elements 34 are inserted in the housing 33, the wedge member 35 cuts the insulation (sheath and insulating member) of the main conductor $W_M$ (VVF cable) at the center portion thereof, prior to the conductive connecting portions 34*a* and 34*b*, so that the subsequent piercing by the conductive connecting portions 34*a* and 34*b* can be facilitated. If the wedge member 35 is made of a hard plastic such as insulating polycarbonate or a filler-embedded reinforced plastic material, the wedge member 35 guarantees the insulation (STET) of the cores of the main conductor $W_M$ between which the wedge member is forced.

Figure 9:
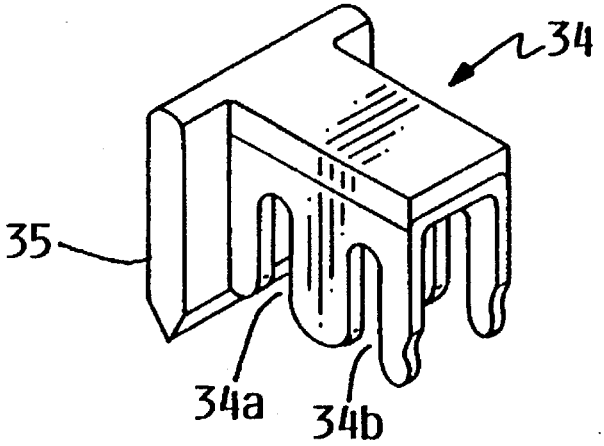
FIG. 9 is a perspective view of a connecting element of the embodiment of FIG. 8.
Figure 10:
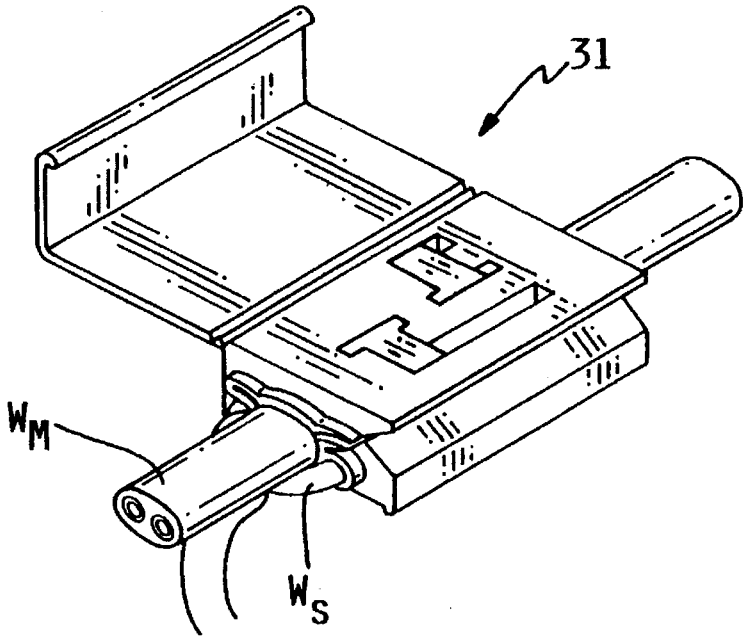
FIG. 10 is a perspective view of the connector apparatus of FIG. 8 with connecting elements attached thereto.
Figure 11:
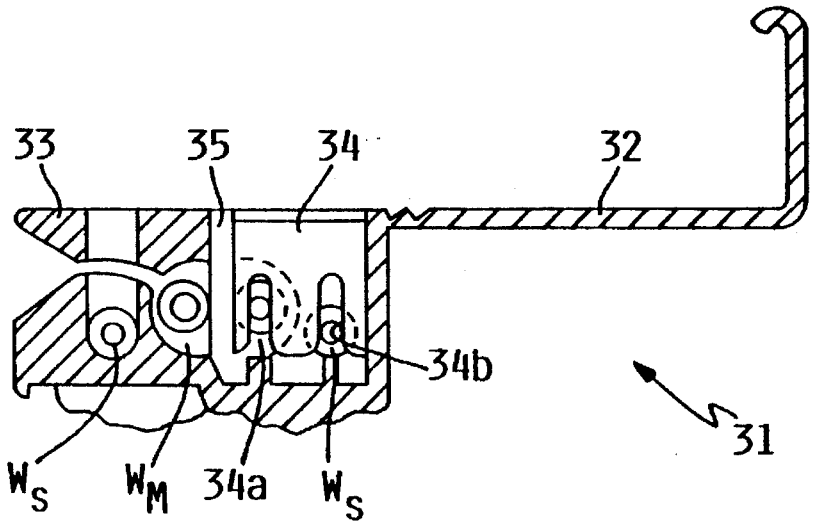
FIG. 11 is a cross-sectional view of the embodiment of the embodiment of FIG. 8 with connecting elements attached thereto.

Note that the housing 33 is covered by the cover 32 for the purpose of insulation after the connecting elements are inserted in the housing. In connection with this, it is preferable that the wedge member 35 is provided with an extension which lies on the otherwise exposed upper surface of the connecting element 34, as shown in FIG. 9.

Figure 12:
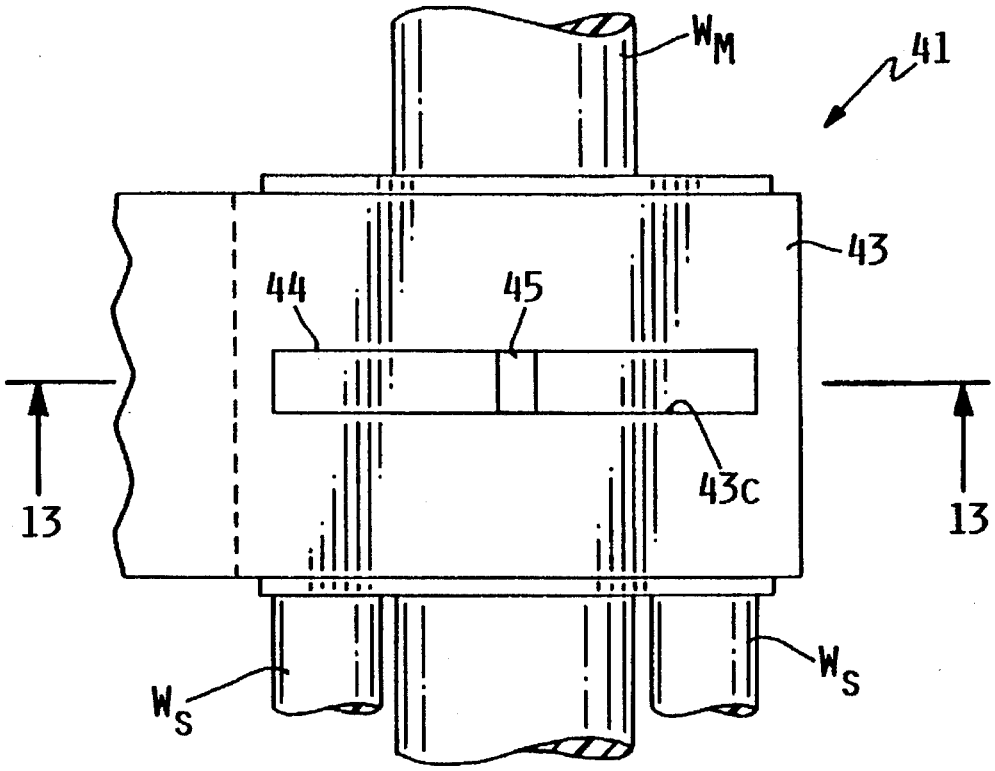
FIG. 12 is a plan view of a fourth embodiment of a connector apparatus.
Figure 13:
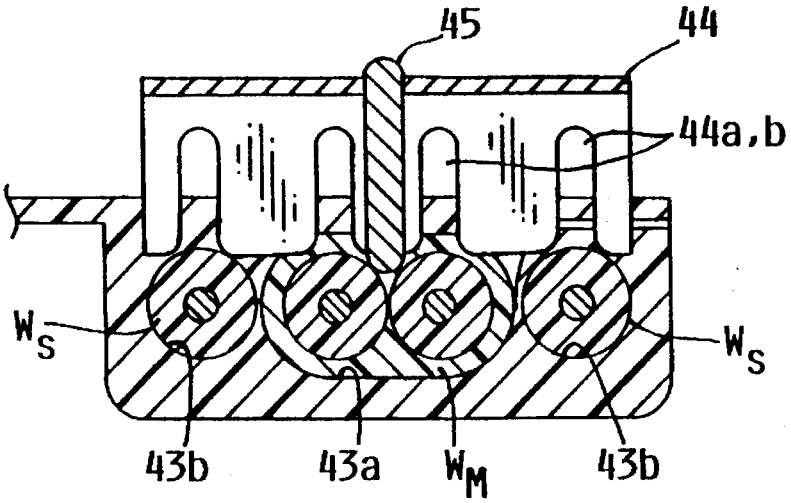
FIG. 13 is a cross-sectional view taken along the line 13—13 of FIG. 12.

FIGS. 12 and 13 illustrate a further embodiment of a connector apparatus 41 comprised of a connecting element 44 which is obtained by connecting the two connection elements in the second embodiment (FIGS. 6 and 7) through the wedge member 45 located therebetween, and a housing 43 having one connecting element inserting portion 43*c* in which the connecting element 44 can be received, a main conductor inserting portions 43*a*, and two branch conductor inserting portions 43*b*.

The wedge member 45 has a sharp front end and a length sufficient to slightly project from the conductive connecting portions 44, similar to the embodiment of FIGS. 8 through 11. Consequently, similarly to that embodiment, the wedge member 45 first cuts the insulation of the main conductor $W_M$ prior to the conductive connecting portions 44*a*, 44*b*, and accordingly, the subsequent piercing by the latter can be easily executed.

In the first through fourth embodiments mentioned above, the branch conductor $W_S$ is in the form of a single electric wire, but in the fifth and sixth embodiments described below, the branch conductor $W_S$ is in the form of an insulated double-core flat cable (VVF cable).

Figure 14:
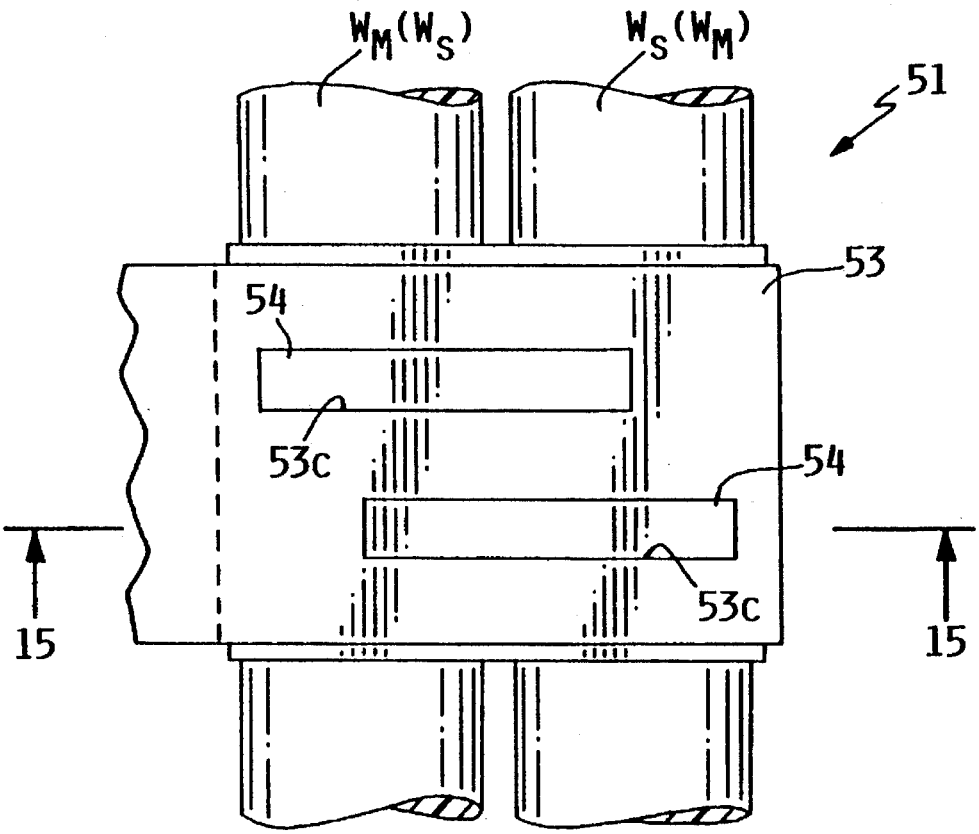
FIG. 14 is a plan view of a fifth embodiment of a connector apparatus.
Figure 15:
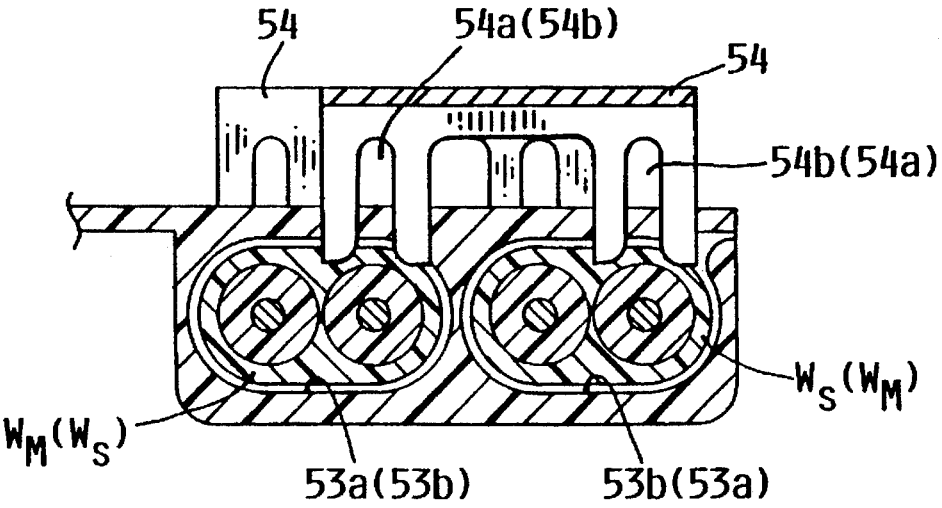
FIG. 15 is a sectional view taken along the line 15—15 of FIG. 14.

Namely, the connector apparatus 51 of the fifth embodiment (FIGS. 14 and 15) is essentially comprised of a housing 53 which is provided with two parallel oval-shaped inserting portions 53*a* and 53*b*, one for the main conductor and the other for the branch conductor, and two connecting elements 54 which can be inserted and fitted in the two connecting element inserting portions 53*c* provided on the upper surface of the housing 53.

The connecting element 54 is substantially identical in the shape, material, and function, to that of the first embodiment, except for the distance between the conductive connecting portions 54*a* and 54*b*, that is slightly larger than that of the first embodiment.

When the connecting elements 54 are inserted in the respective connecting element inserting portions 53*c* of the housing 53, the two conductive connecting portions 54*a* on one side of the connecting elements 54 pierce the insulation (sheath and insulating member) of the main conductor $W_M$ (VVF cable) to penetrate one core of the main conductor to thereby come into electrical engagement therewith. The other two conductive connecting portions 54*b* on the other side pierce the insulation (sheath and insulating member) of the branch conductor $W_S$ (VVF cable) to thrust into the corresponding core of the branch conductor to thereby come into electric connection therewith.

The connecting element need not be of the same length. It would be possible to use one short member 54 and one long member 54, to connect the two innermost conductors and the two outermost conductors, respectively.

Figure 16:
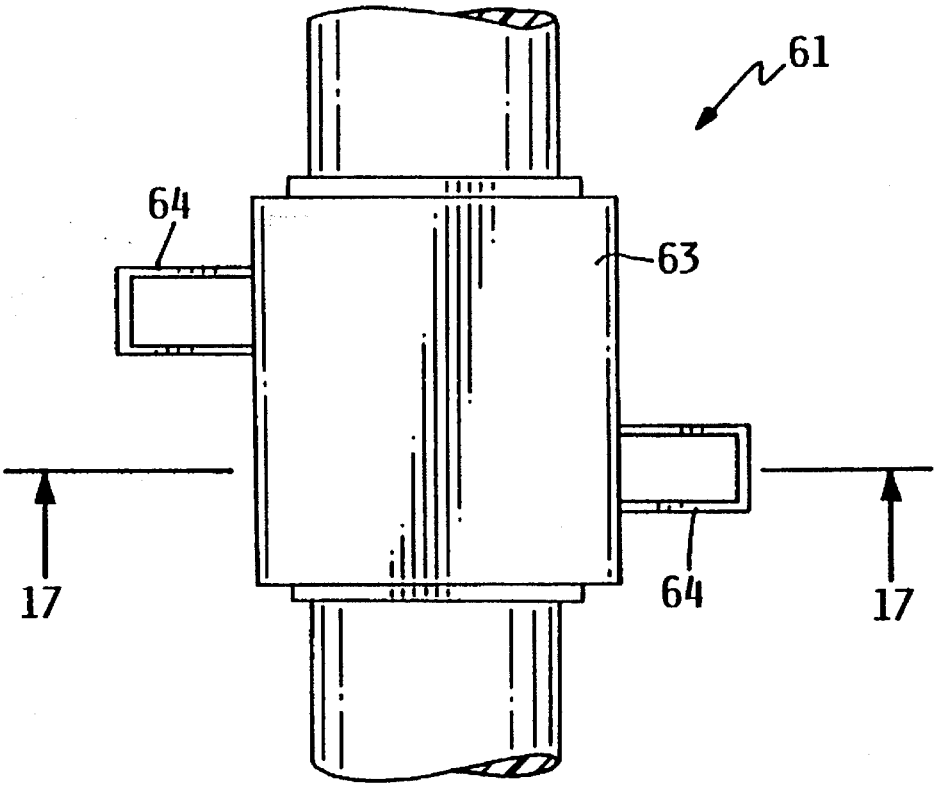
FIG. 16 is a plan view of a sixth embodiment of a connector apparatus.
Figure 17:
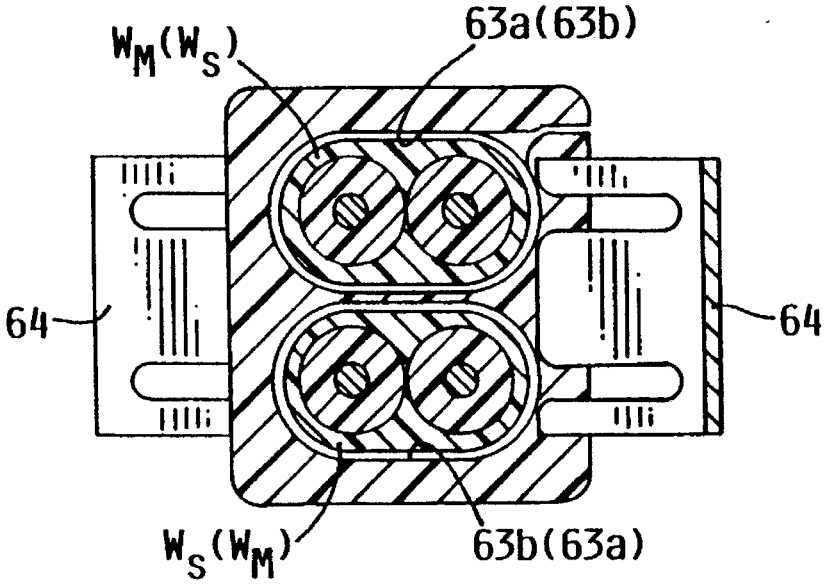
FIG. 17 is a cross-sectional view taken along the line 17—17 of FIG. 16.

As shown in FIGS. 16 and 17, the connector apparatus 61 of the sixth embodiment is basically composed of a housing 63 which is provided with two juxtaposed parallel oval-shaped inserting portions 63*a*, 63*b*, one for the main conductor and the other for the branch conductor, and connecting elements 64 which are inserted and fitted in the opposite side faces of the housing 63. The connecting elements 64 are substantially the same as the connecting elements in the first embodiment.

In the sixth embodiment, the connecting elements 64 are inserted and fitted to the side surfaces of the housing, unlike the above-mentioned embodiments, but there is no difference therebetween, from the view point of the electric connection between the main conductor and the branch conductor.

As can be seen from the foregoing, according to the present invention, the branching operation can be easily and quickly carried out without cutting the main conductor or without removing the insulation of the main conductor and the sheath and insulating member of the branch conductor, thus resulting in an improved efficiency and reliability.

We claim:

1. A connector for electrically connecting one conductor of a first cable having two parallel electrical conductors electrically insulated from each other by a unitary sheath of insulative material to the conductor of a second cable having one electrical conductor electrically insulated by a unitary sheath of insulative material, said connector comprising:

a housing including a first cable insertion portion sized to accept and closely surround the entire first cable, a second cable insertion portion sized to accept and closely surround the second cable and at least one connecting element inserting portion, said first and said second cable insertion portions being oriented so as to maintain said first and said second cables in parallel;

at least one connecting element for insertion into said housing connecting element insertion portion, said connecting element including at least two connecting recesses for contacting one of the cable conductors of said first cable at one recess and the conductor of the second cable at the other of said recesses, and insulation-piercing portions adjacent said recesses;

wherein when said connecting element is inserted in the connecting element inserting portion with the first and second cables in said housing, one of said two recesses pierces the insulation of the first cable to engage and electrically connect to one first cable conductor, and the other of said recesses pierces the insulation of the second cable to engage and electrically connect to the second cable conductor so that an electrical connection therebetween is established.

2. A connector for electrically connecting each conductor of a first cable having two parallel electrical conductors electrically insulated from each other by a unitary sheath of insulative material to a different one of the conductors of a second cable having two parallel electrical conductors electrically insulated from each other by a unitary sheath of insulative material, said connector comprising:

a housing including a first cable insertion portion sized to accept and closely surround the entire first cable, a second cable insertion portion sized to accept and closely surround the entire second cable and two connecting element inserting portions, said first and said second cable insertion portions being oriented so as to maintain said first and said second cables in parallel;

two connecting elements for insertion into said housing connecting element insertion portions, said connecting elements each including two connecting recesses for contacting one of the cable conductors of said first cable at one recess and one of the conductors of the second cable at the other of said recesses, and insulation-piercing portions adjacent said recesses;

wherein when said connecting elements are inserted in the connecting element inserting portion with the first and second cables in said housing, one of said two recesses pierces the insulation of the first cable to engage and electrically connect to one first cable conductor, and the other of said recesses pierces the insulation of the second cable to engage and electrically connect to one second cable conductor so that an electrical connection therebetween is established; and wherein said first cable insertion portion and said second cable insertion portion are disposed in stacked, parallel relationship with their edges aligned so that each of said connecting elements may approach said cable from opposite directions to enqage one conductor of each cable without forcing any portion of said connecting elements between said two conductors of either cable.

* * * * *